US006942314B2

(12) United States Patent
Sakamoto

(10) Patent No.: US 6,942,314 B2
(45) Date of Patent: Sep. 13, 2005

(54) INKJET RECORDING APPARATUS AND CLEANING UNIT FOR THE SAME

(75) Inventor: Atsushi Sakamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/456,623

(22) Filed: Jun. 9, 2003

(65) Prior Publication Data

US 2003/0234830 A1 Dec. 25, 2003

(30) Foreign Application Priority Data

Jun. 25, 2002 (JP) ..... 2002-184240
May 22, 2003 (JP) ..... 2002-144904

(51) Int. Cl.[7] ..... B41J 2/165; B41J 2/145; B41J 2/05

(52) U.S. Cl. ..... 347/33; 347/40; 347/58

(58) Field of Search ..... 347/22, 33, 40, 347/47, 50, 57, 58; 29/890.1; 216/27

(56) References Cited

U.S. PATENT DOCUMENTS 5,016,023 A * 5/1991 Chan et al. ..... 347/42
6,536,868 B1 * 3/2003 Kawamura et al. ..... 347/40
6,746,096 B2 6/2004 Sakamoto et al. ..... 347/23
6,883,897 B2 4/2005 Kinoshita et al. ..... 347/33

* cited by examiner

*Primary Examiner*—Shih-wen Hsieh
(74) *Attorney, Agent, or Firm*—Fitzpatrick, Cella, Harper & Scinto

(57) ABSTRACT

An inkjet recording apparatus performs recording by using an inkjet head having a depression between a nozzle member and a wiring member in a direction in which the inkjet head and a wiper relatively move. In the inkjet recording apparatus, the wiper can perform good wiping of the surface of the wiring member and the surface of the nozzle member.

6 Claims, 4 Drawing Sheets

INKJET RECORDING APPARATUS AND CLEANING UNIT FOR THE SAME

BACKGROUND OF THE INVENTION

1. Field of the Invention

The present invention relates to an inkjet recording apparatus that performs recording by ejecting ink droplets from a plurality of ejecting portions of a recording head, and a novel structure of a cleaning unit for the inkjet recording apparatus.

2. Description of the Related Art

In recent years, inkjet printers have been widely used as printer apparatuses, an increase in speed of printing and an increase in image quality in the printers are in great demand. A common inkjet printer moves an inkjet head in a main-scanning direction and moves printing paper in a sub-scanning direction, and forms a dot-matrix image on the printing paper by using ink droplets ejected from the inkjet head.

In the inkjet printer, minute ink droplets scattering on the surface of the printing paper, powder of paper separated from the surface of the printing paper, etc., easily adhere to the surface of the inkjet head. In this case, the adhering materials hinder ejection of ink droplets and deflect a direction in which the ink droplets are ejected, so that there may be deterioration in printing quality.

Accordingly, to solve such a problem, it is common that an inkjet printer of the present type cleans the surface of an inkjet head by using a wiper to perform wiping. Wiping mechanisms include various structures. For example, in a common type of structure, by controlling an elastic wiper to touch or not to touch the surface of the inkjet head, which is moved in the main-scanning direction, the surface of the inkjet head is wiped by the wiper in one direction such as the main-scanning direction.

In one of various inkjet structures, a nozzle member and a wiring member are provided, for example, on the surface of a head substrate in an integrated form. In an inkjet head having this structure, the nozzle member has a nozzle array in which many ink nozzles are arranged in a sub-scanning direction. Each ink nozzle has a built-in driving element that ejects ink droplets in response to an externally input driving signal.

The wiring member has signal wires formed thereon through which externally input driving signals are transmitted to the driving elements on the nozzle member. Thus, driving signals supplied from the main unit of an inkjet printer are transmitted to the driving elements on the nozzle member by the signal wires on the wiring member.

In the case of producing an inkjet head of the above type, for example, the wiring member, in which a rectangular hole is formed, is provided on the surface of the head substrate, and by inserting the nozzle member into the rectangular hole of the wiring member, the nozzle member is provided on the head substrate. In an inkjet head for color printing, the nozzle member has a plurality of nozzle arrays in the main-scanning direction. Thus, signal wires connecting to the driving elements of the nozzle member are formed, reaching two opposite ends in the sub-scanning direction, and the rectangular hole on the wiring member is formed so that the nozzle member can abut against the rectangular hole at the opposite ends in the sub-scanning direction.

Accordingly, a robot arm that holds and inserts the nozzle member into the rectangular hole must hold the nozzle member from two sides in the main-scanning direction. Thus, the rectangular hole of the wiring member is formed in such a shape that it is positioned away from the two opposite ends of the nozzle member. Also, since the signal wires between the wiring member and the nozzle member are connected by using bonding wires, in order to facilitate the operation of the connection, the wiring member is formed so that its surface is higher than that of the nozzle member.

In the above inkjet head, the surface of the wiring member is higher than that of the nozzle member, and there is a gap between the nozzle member and the wiring member. This may cause a case in which, when the wiper wipes the surface of the wiring member and the surface of the nozzle member, the wiper fails to perform good wiping of the location of the nozzle arrays.

In other words, since the elasticity of the wiper causes the wiper to abut against the surface of the nozzle member, etc., for example, in a case in which the moving speed of the wiper is large, the distance from an end of the nozzle member to the nozzle arrays is small, and a difference in height between the wiring member and the nozzle member is large, an operation of the tip of the wiper which follows the surface of the nozzle member slows down, so that the wiper may jump over the nozzle arrays. Also, in a case in which there is a broad and deep gap between the wiring member and the nozzle member, the wiper collides with an end of the nozzle member after the tip of the wiper falls in the gap, and the collision may cause the tip of the wiper to jump over the nozzle arrays.

To prevent the above defects, for example, the moving speed of the wiper may sufficiently be reduced. However, as described above, the wiper moves in the main-scanning direction in the inkjet head, whereby the wiper relatively moves on the surface of the nozzle member. Thus, a reduction in the moving speed reduces the printing speed of the inkjet printer.

In addition, since the printing speed of the inkjet printer has increased in recent years, the moving speed of the inkjet head has inevitably increased. In other words, since the moving speed of the wiper has also increased, the above wiping defects occur frequently.

SUMMARY OF THE INVENTION

It is an object of the present invention to provide an inkjet recording apparatus for performing recording by using an inkjet head having a depression between a nozzle member and a wiring member in a direction of relative movement between the inkjet head and a wiper, wherein the wiper is used to perform good wiping of the surface of a nozzle member and the surface of a wiring member.

It is another aspect of the present invention to provide an inkjet recording apparatus for performing recording by using an inkjet head including a head substrate on which a nozzle member having a plurality of nozzles and a wiring member are provided in an integrated form, wherein the inkjet head includes a wiper for wiping the nozzle member in the inkjet head and has a depression between the nozzle member and the wiring member in a direction of relative movement between the inkjet head and the wiper, and the wiper wipes the surface of the nozzle member and the wiring member.

According to an aspect of the present invention, an inkjet recording apparatus for performing recording by an inkjet head is provided. The inkjet head includes a nozzle member having a plurality of nozzles, a wiring member, a head substrate whose surface is provided with the nozzle member and the wiring member in an integrated form, and a depression provided between the nozzle member and the wiring member in a direction of relative movement between the nozzle member and a wiper. The wiper is provided for wiping the nozzle member in the inkjet head, and the wiper wipes the surface of the nozzle member as well as the surface of the wiring member.

According to another aspect of the present invention, an inkjet recording apparatus for performing recording by an inkjet head is provided. The inkjet head includes a nozzle member having a plurality of nozzles, a wiring member, a head substrate whose surface is provided with the nozzle member and the wiring member in an integrated form, a depression provided between the nozzle member and the wiring member in a direction of relative movement between the nozzle member and a wiper, and a cleaning unit including the wiper. The wiper is provided for wiping the nozzle member in the inkjet head, and the wiper wipes the surface of the nozzle member as well as the surface of the wiring member.

Further objects, features and advantages of the present invention will become apparent from the following description of the preferred embodiment with reference to the attached drawings.

DESCRIPTION OF THE PREFERRED EMBODIMENTS

Figure 1:
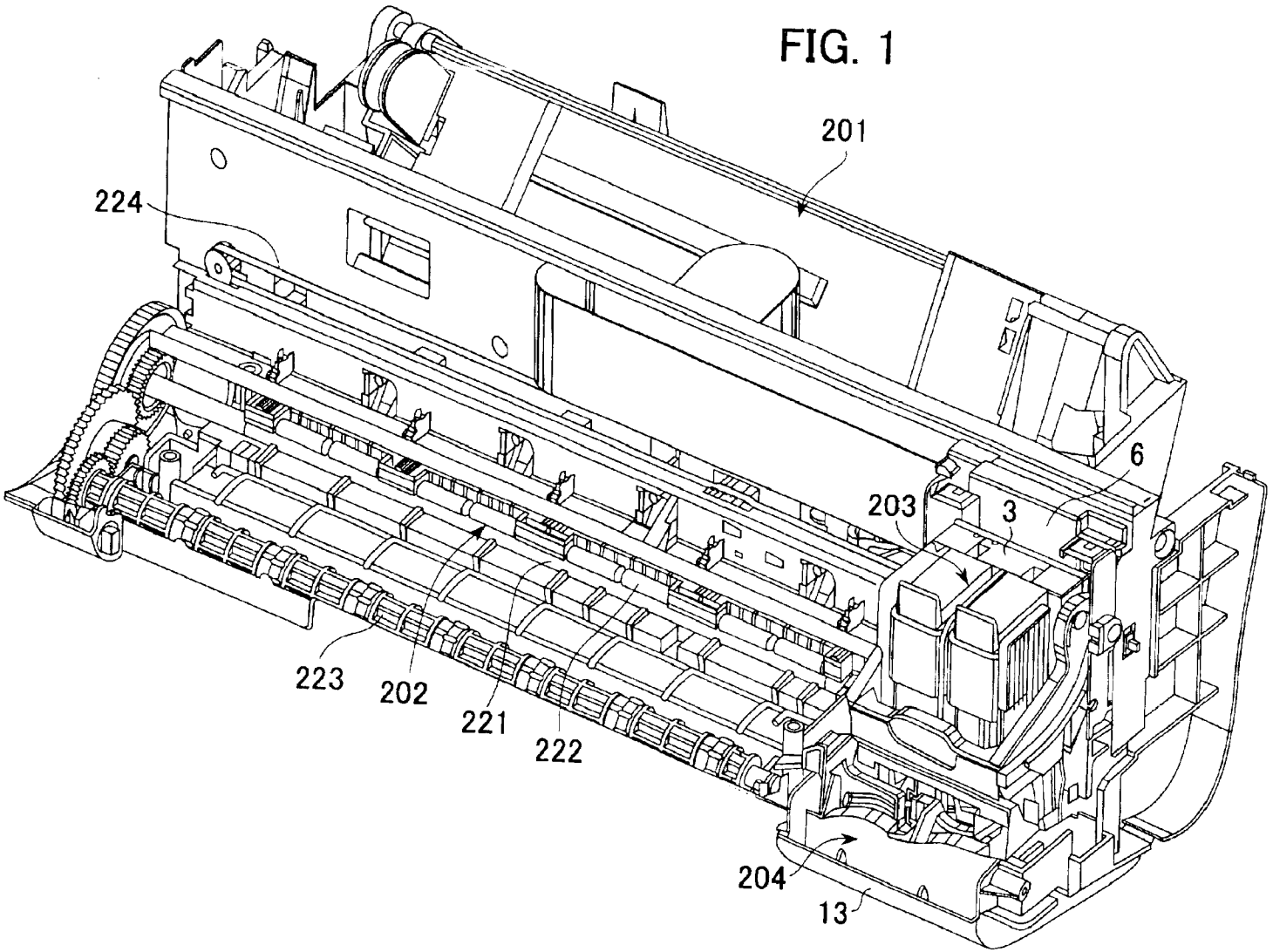
FIG. 1 is a schematic perspective view showing an inkjet recording apparatus according to an embodiment of the present invention to which the present invention is applied.

A specific embodiment of the present invention is described below with reference to the accompanying drawings. In the accompanying drawings, identical reference numerals denote identical portions or corresponding portions.

FIG. 1 is a schematic perspective view showing an inkjet recording apparatus according to an embodiment of the present invention to which the present invention is applied. The inkjet recording apparatus in FIG. 1 includes a paper feeder 201 for supplying the inside of the inkjet recording apparatus with recording material such as recording paper, a carrier 202 for feeding the recording material in the inside (such as a recording unit) of the inkjet recording apparatus 202, a recording mechanism 203 for recording an image (including characters and symbols) onto the recording material based on image information, and a cleaning mechanism 204 (recovery mechanism) for maintaining the quality of the image formed by the recording mechanism 203.

Sheets of the recording material which are stacked on the paper feeder 201 are fed to the carrier 202 by a feeding roller driven by a feeding motor, with each sheet separated. The sheet of the recording material fed to the carrier 202 is carried through the recording unit by a friction carrying force caused by a carrying roller 221 driven by a carrying motor and a pinch roller 222 pressed by the carrying roller 221. While the sheet of the recording material is being fed (carried based on a pitch) in the recording unit, an image (including characters and symbols) is recorded onto the sheet of the recording material by the recording mechanism 203. The image-recorded sheet is discharged outside the inkjet recording apparatus by a carrying force generated such that the image-recorded sheet is pressed between a discharging roller 223 driven cooperatively with the carrying roller 221 and a spur in cooperation with the discharging roller 223.

The recording mechanism 203 includes a carriage 6 supported for guidance so as to reciprocate in a main-scanning direction inside the inkjet recording apparatus, and a recording head 3 as a recording unit. The carriage 6 is provided with the recording head 3, and the carriage 6 is supported for guidance so as to reciprocate along a guide rail provided on the main part of the inkjet recording apparatus. A driving force from a carriage motor is transmitted to the carriage 6 by a carriage belt 224. The driving force from the carriage motor causes the carriage 6 to reciprocate along the guide rail. The recording operation of the recording head 3, performed in synchronization with the reciprocating movement (main scanning) of the carriage 6, and feeding (sub scanning) for each predetermined pitch are repeatedly performed, whereby recording onto the entire sheet of the recording material is performed. The cleaning mechanism (recovery mechanism) 204 is used to maintain or recover recording quality to a normal (good) state by eliminating clogging, etc., in the recording head 3 (inkjet head) in the inkjet recording apparatus. As described later, the cleaning mechanism 204 includes a pump unit for aspirating or ejecting ink from an ejecting portion, a cap unit for covering the ejecting portion, and a wiping unit for wiping and cleaning the ejecting portion.

The recording head 3 as a recording unit is an inkjet recording head that uses thermal energy to eject ink, and includes an electrothermal converter for generating thermal energy. The recording head 3 causes film boiling in the ink by using thermal energy applied by the electrothermal converter, and performs recording by ejecting the ink from the ejecting portion by using a change in pressure caused by the growth and contraction of bubbles produced at the film boiling. For a plurality of ejecting portions, corresponding electrothermal converters are arranged. In accordance with recording information (recording signal), pulse voltages are applied to corresponding electrothermal converters, whereby ink droplets are ejected from corresponding ejecting portions.

The embodiment of the present invention is described below with reference to FIGS. 2A and 2B.

Figure 2A:
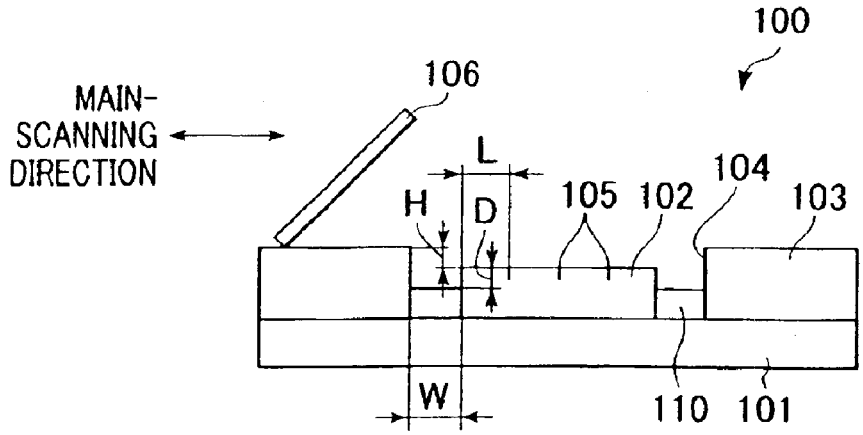
FIGS. 2A and 2B are a front view and a plan view which illustrate an inkjet head according to the present invention.
Figure 2B:
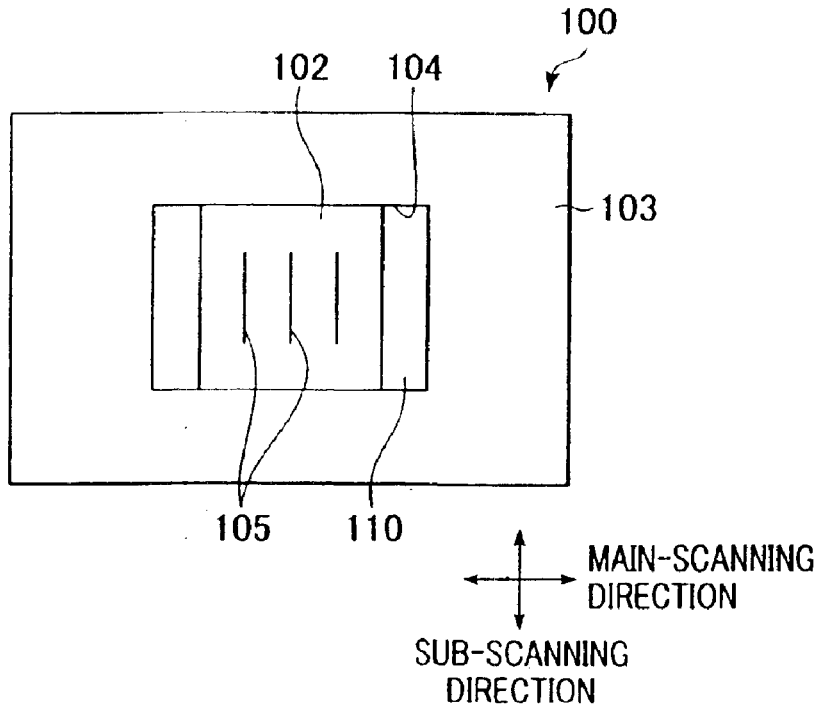

As FIGS. 2A and 2B show, an inkjet head 100 in the embodiment includes a planar head substrate 101, and a planar nozzle member 102 and a planar wiring member 103 which are provided on the surface of the head substrate 101 in an integrated form. In the main-scanning direction, that is, a direction in which the inkjet head 100 and a wiper 106 relatively move, the nozzle member 102 and the wiring member 103 are adjacent to each other. More specifically, the wiring member 103 has a rectangular through-hole 104 formed in the center, and the nozzle member 102 is disposed inside the through-hole 104, having a rectangular shape.

The nozzle member 102 has three nozzle arrays 105 (for yellow, magenta, and cyan) arranged in the main-scanning direction. The nozzle arrays 105 each have many ink nozzles (not shown) arranged in the sub-scanning direction, that is, the longitudinal direction of the wiper 106. Each ink nozzle has a built-in driving element (not shown) such as a heating element. The driving element ejects an ink droplet from the ink nozzle in response to an externally input driving signal. Also, the direction in which the nozzle arrays 105 and the wiper 106 relatively move is the main-scanning direction.

The wiring member 103 has signal wires (not shown) formed thereon which transmit an externally input driving signal to driving elements on the nozzle member 102. The signal wires are connected to signal wires (not shown) of the nozzle member 102 by wire bonding at two opposite ends in the sub-scanning direction.

In the inkjet head 100 in the embodiment, to facilitate the wire bonding, the surface of the wiring member 103 is positioned higher than that of the nozzle member 102. Also, to easily insert the nozzle member 102 into the through-hole 104 on the wiring member 103, there is a depression between the nozzle member 102 and the wiring member 103 in the main-scanning direction.

As FIG. 2A shows, the wiper 106 is supported by a wiping mechanism (not shown) so as to be vertically moved. When the inkjet head 100 returns to its initial position in the main-scanning direction, the wiper 106 is pressed to touch the surface of the inkjet head 100, if needed. In this embodiment, the inkjet head 100 has the distance L between an end of the nozzle member 102 and the nozzle arrays 105, the height H of the surface of the wiring member 103 compared with the surface of the nozzle member 102, the width W of the depression, in which a wiping operation on the wiring member 103 ends at one end of the depression and a wiping operation on the nozzle member 102 starts at the other end of the depression, and the depth D of the depression having the width W from the surface of the nozzle member 102.

In the inkjet head 100 in the embodiment, the wiper 106 passes through a groove which is a depression lower than the surface of the nozzle member 102 and which has the depth D and the width W before passing the nozzle member 102.

An inkjet head of the related art does not have any arrangement in which there is a depression lower than the surface of a nozzle member in a wiper scanning direction before the nozzle member. In this arrangement, the wiper passes two different levels until reaching the nozzle member. In many cases, the wiper is made of elastic material such as rubber. Thus, when the wiper passes from a higher to lower level, or from a lower to higher level, a jump of the wiper, drawing of ink, etc., occur, so that it is difficult to control cleaning of the section of the nozzle arrays 105.

However, by setting various parameters, the present inventor has found an arrangement which can be applied under a very wide range of wiping conditions although the above arrangement is employed. Specifically, the present inventor set the ranges of the distance L between one end of the nozzle member 102 and the nozzle arrays 105, the height H of the surface of the wiring member 103 compared with the surface of the nozzle member 102, the width W of the depression, in which a wiping operation on the wiring member 103 ends at one end of the depression and a wiping operation on the nozzle member 102 starts at the other end of the depression, and the depth D of the depression from the surface of the nozzle member 102.

In the set parameters, the wiper 106, which wipes the surface of the nozzle member 102 and the surface of the wiring member 103, cannot jump over the nozzle arrays 105, and the wiper 106 cannot draw ink adhering to the bottom of the depression up to the location of the nozzle arrays 105.

In addition, since the gap between the nozzle member 102 and the wiring member 103 is filled with insulating resin 110, the depth D of the gap can be easily adjusted to a desired range by the quantity of the insulating resin 110. Moisture can be prevented from penetrating from the above gap through a gap between the head substrate 101 and each of the members 102 and 103.

Here, the results of experiments performed by the present inventor are described below as examples. In order to examine the influence of the height H, the present inventor produced prototypes in which the width W of the groove as the depression was set to zero and the height H was variously changed. A total of twelve experiments were performed in which the wiper 106 was caused to abut against the surface of the inkjet head 100 at three pressures of 2.0, 3.0, and 4.0 (gf/mm$^2$) and was moved at four speeds of 50, 100, 150, and 200 (mm/sec).

Figure 3:
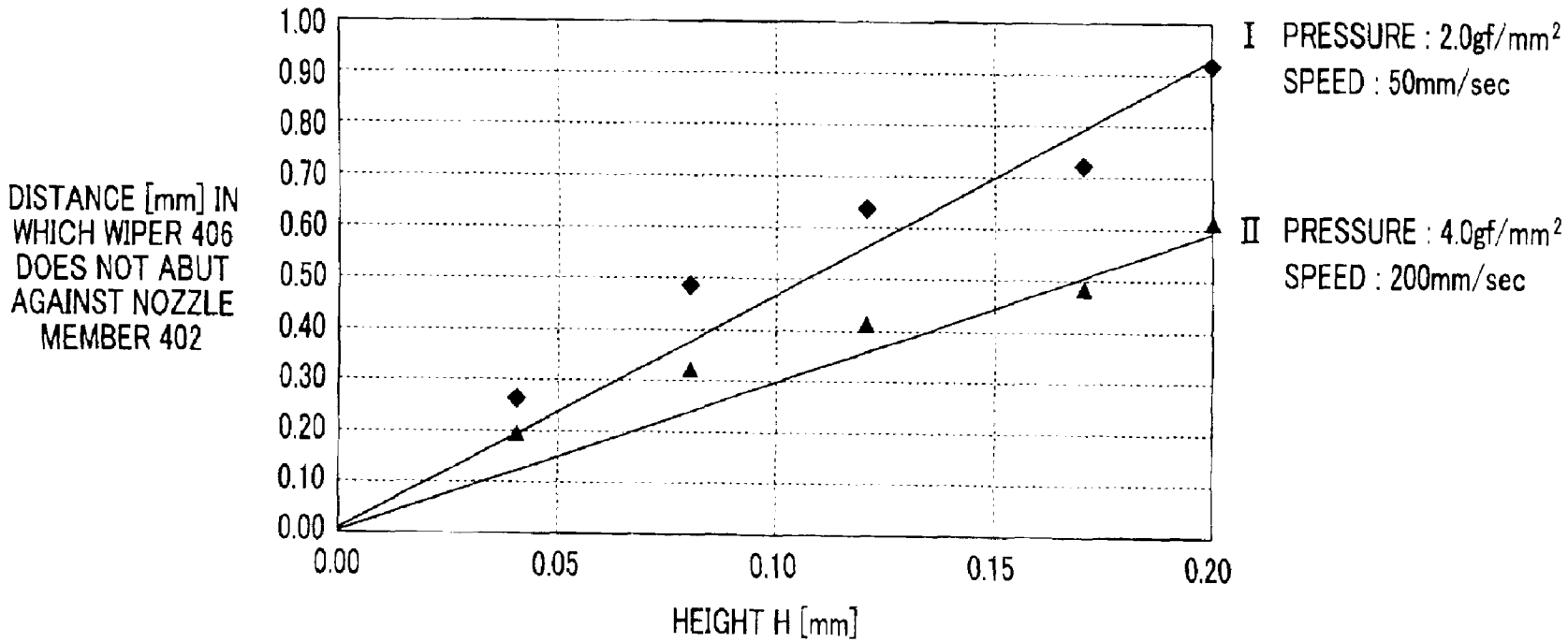
FIG. 3 is a graph showing relationships between the height H of the surface of a wiring member to the surface of a nozzle member and a distance in which a wiper does not abut against the nozzle member.

A distance from a position in which the wiper 106 was at one end of the wiring member 103 to a position in which the wiper 106 abutted against the surface of the nozzle member 102 was measured. As a result, in the case I shown in FIG. 3 of 2.0 gf/mm$^2$ and 50 mm/sec, the distance from the position in which the wiper 106 was at the one end of the wiring member 103 to the position in which the wiper 106 abutted against the surface of the nozzle member 102 was the largest, and it was found that the relationship between the above distance and the height H was almost linear. Also, in the case II shown in FIG. 3 of 4.0 gf/mm$^2$ and 200 mm/sec, the distance from the position in which the wiper 106 was at the one end of the wiring member 103 to the position in which the wiper 106 abutted against the surface of the nozzle member 102 was the smallest, and it was found that the relationship between the above distance and the height H was almost linear. In addition, it was confirmed that other cases were in the range between the case I and the case II.

This confirmed that, when the height H was 0.2 mm or less under conditions of a pressure of 2.0 gf/mm$^2$ or greater and a wiper speed of 50 mm/sec or greater, the sum of the distance from one end of the nozzle member 102 to one nozzle array 105 and the groove width W satisfied a value of 1.0 mm or greater, whereby cleaning of the nozzle arrays 105 could be performed without being affected by a jump of the wiper 106.

Figure 4:
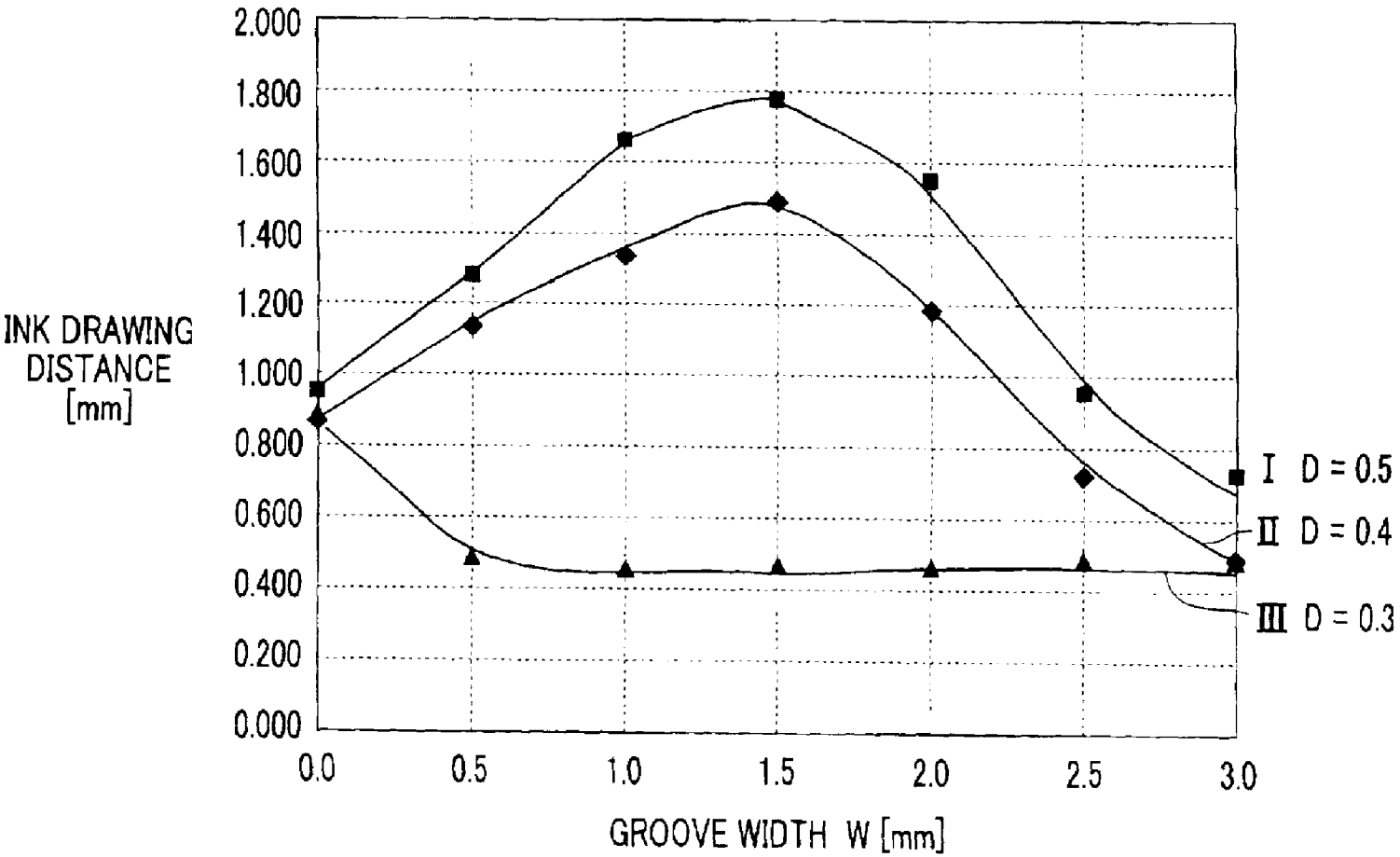
FIG. 4 is a graph showing relationships between a width W formed by the widths of the nozzle member and the wiring member, and a distance in which the wiper draws ink.

Next, prototypes were produced in which the height H was 0.2 mm, the distance L from the one end of the nozzle member 102 was 0.5 mm, and the groove width W and the groove depth D from the nozzle member 102 were variously changed. A total of twelve experiments were performed in which the wiper 106 was caused to abut against the surface of the inkjet head 100 at three pressures of 2.0, 3.0, and 4.0 (gf/mm$^2$) and was moved at four speeds of 50, 100, 150, and 200 (mm/sec). An ink drawing distance in which ink was drawn from the one end of the nozzle member 102 by the wiper 106 was measured. The values of the ink drawing distance decrease in the order of the case I shown in FIG. 4 of a pressure of 2.0 gf/mm$^2$, a speed of 50 mm/sec, and a groove width D of 0.5 mm, the case II shown in FIG. 4 of a pressure of 2.0 gf/mm$^2$, a speed of 50 mm/sec, and a groove width D of 0.4 mm, and the case III shown in FIG. 4 of a pressure of 2.0 gf/mm$^2$, a speed of 50 mm/sec, and a groove width D of 0.3 mm. Also, in all the eleven remaining cases having changed pressures and speeds of the wiper 106, it was found that, when the groove distance D was not greater than 0.3 mm and the groove width W was greater than 0.5 mm and not greater than 3.0 mm, the ink drawn by the operation of the wiper 106 did not reach the nozzle arrays 105.

In other words, the above experiments have confirmed that, when the distance L, the height H, the groove width W, and the depth D satisfy the following relationships:

$$0.5 \leqq L \text{ (mm)}$$

$$0 \leqq H \leqq 0.2 \text{ (mm)}$$

$$0.5 < W \leqq 3.0 \text{ (mm)}$$

$$0 < D \leqq 0.3 \text{ (mm)}$$

the wiper 106 for wiping the surface of the nozzle member 102 and the surface of the wiring member 103 does not jump over the nozzle arrays 105, and also have confirmed that the ink adhering to the bottom of the depression is not drawn to the location of the nozzle arrays 105 by the wiper 106.

As is clear from the foregoing description, according to the examples, an inkjet recording apparatus including an inkjet head having a depression between a nozzle member and a wiring member in a direction the inkjet head and a wiper relatively move, the wiper can perform good wiping of the surface of the wiring member and the surface of the nozzle member.

While the present invention has been described with reference to what are presently considered to be the preferred embodiments, it is to be understood that the invention is not limited to the disclosed embodiments and examples. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet recording apparatus for performing recording by an inkjet head, the inkjet head including:

a nozzle member having a plurality of nozzle arrays;

a wiring member;

a head substrate whose surface is provided with the nozzle member and the wiring member in an integrated form; and a depression provided between the nozzle member and the wiring member in a direction of relative movement between the nozzle member and a wiper, wherein the wiper is provided for wiping the nozzle member of the inkjet head, and the wiper relatively moves in a direction crossing the nozzle arrays and wipes the surface of the nozzle member as well as the surface of the wiring member, and wherein a gap is formed between the nozzle member and the wiring member and is filled with an insulating member and the depression is formed of the gap between the nozzle member and the wiring member and a surface of the insulating member.

2. An inkjet recording apparatus according to claim 1, wherein the nozzle arrays are aligned in the longitudinal direction of the wiper, and in the inkjet head, the following relationships are satisfied:

$$0.5 \leqq L \text{ (mm)};$$

$$0 \leqq H \leqq 0.2 \text{ (mm)};$$

$$0.5 < W \leqq 3.0 \text{ (mm), and}$$

$$0 < D \leqq 0.3 \text{ (mm)},$$

where L represents a distance between one end of the nozzle member and one of the nozzle arrays, H represents a height of the surface of the wiring member compared with a height of the surface of the nozzle member, W represents a width of the depression, in which a wiping operation on the wiring member ends at one end of the depression and a wiping operation on the nozzle member starts at the other end of the depression, and D represents a depth of the depression having the width W from the surface of the nozzle member.

3. An inkjet recording apparatus according to claim 1, wherein the inkjet head further includes an electrothermal converter for generating thermal energy for use in ink ejection.

4. An inkjet recording apparatus according to claim 3, wherein the inkjet head ejects ink from the nozzle arrays by using film boiling in the ink which is caused by the thermal energy generated by the electrothermal converter.

5. An inkjet recording apparatus according to claim 1, wherein a relative speed S and abutting pressure P of the wiper against the surface of the nozzle member satisfy the following relations:

$$20 \leqq S \leqq 200 \text{ (mm/sec)}$$

$$2.0 \leqq P \leqq 4.0 \text{ (gf/mm}^2\text{)}.$$

6. An inkjet recording apparatus for performing recording and including an inkjet head and a cleaning unit including a wiper, the inkjet head including:

a nozzle member having a plurality of nozzle arrays;

a wiring member;

a head substrate whose surface is provided with the nozzle member and the wiring member in an integrated form; and a depression provided between the nozzle member and the wiring member in a direction of relative movement between the nozzle member and the wiper;

wherein the wiper is provided for wiping the nozzle member of the inkjet head, and the wiper relatively moves in a direction crossing the nozzle arrays and wipes the surface of the nozzle member as well as the surface of the wiring member, and wherein a gap is formed between the nozzle member and the wiring member and is filled with an insulating member and the depression is formed of the gap between the nozzle member and the wiring member and a surface of the insulating member.

* * * * *

UNITED STATES PATENT AND TRADEMARK OFFICE

CERTIFICATE OF CORRECTION

PATENT NO. : 6,942,314 B2
APPLICATION NO. : 10/456623
DATED : September 13, 2005
INVENTOR(S) : Sakamoto It is certified that error appears in the above-identified patent and that said Letters Patent is hereby corrected as shown below:

ON THE TITLE PAGE
Item (30), Foreign Application Priority Data, "2002-144904" should read --2003-144904--.

COLUMN 8
Line 5, "(mm)," should read --(mm);--.
Line 47, "wiper;" should read --wiper,--.

Signed and Sealed this

First Day of May, 2007

JON W. DUDAS
*Director of the United States Patent and Trademark Office*